United States Patent [19]

Goldmann

[11] Patent Number: 4,866,889

[45] Date of Patent: Sep. 19, 1989

[54] SAND BLASTING CABIN

[76] Inventor: Klaus-Dieter E. Goldmann, Neckarhauser Str. 29-33, 6800, Mannheim 71, Fed. Rep. of Germany

[21] Appl. No.: 52,058

[22] Filed: May 20, 1987

[51] Int. Cl.[4] ..... B24C 3/14

[52] U.S. Cl. ..... 51/426; 51/410; 51/424

[58] Field of Search ..... 51/424, 425, 426, 415, 51/410, 431, 436, 310; 198/743

[56] References Cited

U.S. PATENT DOCUMENTS

| | | | |
|---|---|---|---|
| Re. 18,586 | 8/1932 | Ruemelin | 51/426 |
| 538,822 | 5/1895 | Draver | 198/743 |
| 731,003 | 6/1903 | Willson | 198/743 |
| 1,601,147 | 9/1926 | Ruemelin | 51/426 |
| 1,997,044 | 4/1935 | Cutler | 198/743 |
| 2,414,038 | 1/1947 | Gossard | 51/424 |
| 2,953,876 | 9/1960 | Zieber | 51/415 |
| 3,309,818 | 3/1967 | Brown | 51/426 |
| 3,436,866 | 4/1969 | Nye | 51/310 |
| 4,326,362 | 4/1982 | Williams | 51/426 |

*Primary Examiner*—Frederick R. Schmidt
*Assistant Examiner*—Blynn Shideler
*Attorney, Agent, or Firm*—Staas & Halsey

[57] ABSTRACT

An apparatus for sandblasting a workpiece includes a sandblasting cabinet having an inner sandblasting chamber, a dust extraction system including an air intake disposed in an upper forward portion relative to the cabinet, an upwardly angled sieve disposed in a rearward position inside the cabinet, and a blasting material recovery system including a suspended floor within the sandblasting chamber and a recovery channel disposed beneath the upwardly angled sieve and behind the suspended floor.

23 Claims, 7 Drawing Sheets

SAND BLASTING CABIN

BACKGROUND OF THE INVENTION

1. Field of the Invention

The present invention relates to a sandblasting cabinet for sandblasting inscriptions and plastified ornaments on workpieces, especially those made of stone, glass, and wood, with a mechanically guided and driven, adjustable blasting nozzle which is guided in X–Y directions over the workpiece surfaces which are to be treated.

2. Description of the Related Art

Known automatic sandblasting devices used in the stone industry are built in a manner such that a rectangular working field which is limited by several final switches is worked off and with that the blasting is done.

These devices do not provide for automatic repetitions of these working fields and must then be stopped manually when a sufficient depth of the inscription or the ornamentation in the workpiece has been reached.

Also, the use of time relays or counters, which work from high to zero where the unit stops after achieving a predetermined number of field repetitions and when having reached a predetermined depth, are already known.

All of these known devices have the disadvantage that only one rectangular working field can be treated and, independent from the space between proper lines and ornaments which should be treated, the whole space of the workpiece is treated.

By this working method, high air pressure and blasting material consumption per piece is necessary because the blasting time is unnecessarily multiplied.

Furthermore, there are no known sandblasting units which have sufficient sound-absorbing properties in view of the air flow in the cabinet to satisfy health regulations.

The known units also do not allow movement of the blasting lance without creating an opening or fissure in the rubber seal where noise and blasting material can escape. There are also no commercially available sandblasting cabinets which are manufactured with a profile frame construction which is lined with noise absorbing material.

Blasting material recovery, if existent, is inefficient. All known devices have an abrasion problem which results in wear between movable parts. Also, known dust extraction systems have disadvantages. For example, not only is blasting material which was still usable removed, but also the workers view is obstructed by particles which spread all around. This tends to diminish the quality of work.

SUMMARY OF THE INVENTION

The present invention has, therefore, the object of creating a sandblasting cabinet which minimizes noise, operates in manual or automatic modes, and provides multiple field working without any down time.

Another object of the invention is to provide a dust extraction system capable of giving the worker an unobstructed view.

Another object of the invention is to provide a blasting material recovery system which is durable and suspended without a foundation.

Another object of the invention is to provide a sandblasting unit which has a separate control station, a separate sandblasting apparatus, and a separate dust extraction device.

The above objects are met by the invention in a way that the sandblasting cabinet is fitted with a noise absorbing cabinet construction and a noise dampening roller curtain in which an automatically guided blasting lace is vertically and horizontally movable according to a multiple working field system. The cabinet has a diagonal air flow resulting from an angled sieve. A blasting material recovery mechanism has a foundationless swinging transportation floor with perpendicular scrapers and a recovery channel.

The roller curtain is vertically movable and has horizontally from left to right movable automatic sealing means through which the blasting lance goes into the cabinet in a soundproof and dust free manner in a guide which is all together incorporated in the roller curtain with a viewing window.

The automatic sealing means includes a rope and a spring, and can be opened in the middle and rolled up to the left and right. Behind the roller curtain on the side to the blasting room a double rubber seal is overlappingly disposed, and behind that, there are channels for guiding back the blasting material into the cabinet. In the manual work mode, a double brush is provided fixedly on the side of the rolled up automatic seal.

In another embodiment, the cabinet includes a double profile frame construction lined with sound absorbing material and having double rubber anti-wear material fitted with spacers.

The blasting material recovery mechanism is built as a swinging frame floor which has a recovery frame fitted with perpendicular scrapers, arranged one after the other, which swing preferably by means of a pneumatic cylinder or electric motor at a rope forwards and backwards, whereas the perpendicular scrapers are articulated into working and rest positions by means of the rope in accordance with movement of the recovery frame.

The turn around points of the rope are outside of the blasting room, and the recovery frame works without wearing guided on its side on suspension means in the cabinet which is perpendicularly fixed.

The diagonal dust extraction mechanism includes an air intake channel mounted above the working and viewing space, preferably on top of the cabinet, and take channel, and an angled sieve within the cabinet above the recovery channel which exhausts the dust-laden air downwardly.

Another preferred embodiment includes a separate dust extraction device and sandblasting apparatus with storage and a separator.

The air intake channel is fitted with "chicanes".

The workpieces to be treated can be brought into the cabinet by means of a crosswise situated roller track.

The blasting room is covered with a blasting material penetrating material, preferably a grating.

Another object of the invention is to provide an automatic device capable of determining a certain number of rectangular working fields of adjustable size which could be worked off with the blasting nozzle.

At least a portion of these fields could be cross-shaped.

The automatic device has two guiding fields, one in the X direction and one in the Y direction, where special operating limits determine the limits of the working fields in variable positions.

The operating limits have a stop dog function for the X–Y directional guiding of the nozzle whereas they cooperate with the final switches of the X–Y guiding.

Preferably, each guiding field has several parallel tracks on which at least a pair of operating limits can be placed.

The number of main tracks determines the number of blasting working fields.

The fields are not only rectangular but also cross-shaped, L-shaped, and E-shaped. At least in one field, changing widths can be obtained while using several operating limits.

One or more input units of the automatic device, with which the number of working fields which should be worked off and/or the number of selectable repetitions per working field, can be pre-adjusted.

The automatic device is fitted with a number of counters, the number being equal to the number of working fields. Each counter counts the number of repetitions for a special field to which it belongs.

The automatic device drives the nozzle after having reached the pre-adjusted number of repetitions from one field to the next field and from the last field preferably into the start position again.

DESCRIPTION OF THE PREFERRED EMBODIMENTS

Figure 1:
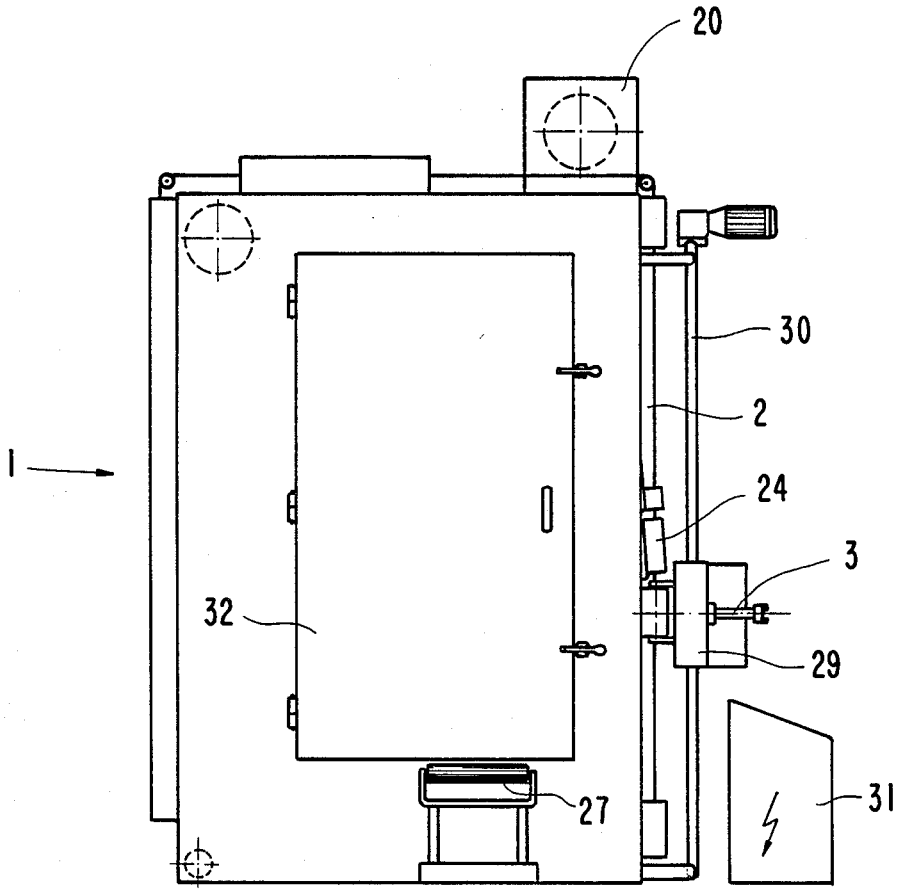
FIG. 1 is a side view of a sandblasting cabinet according to the present invention.

FIG. 1 shows a side view of a sandblasting cabinet 1. An automatic guide 29 with the blasting lance 3 is guided on cylindrical guide rails 30 and is movable up and down. This can be done manually or automatically. A viewing window 24 enables a worker to look into a blasting room within the cabinet 1. Above the sandblasting cabinet 1 there is an air intake channel 20 (which will be explained later). A special feature of the invention is a separate control station 31. A workpiece is brought into the cabinet 1 over a roller track 27. The door 32 is fitted with a locking and safety device.

Figure 2:
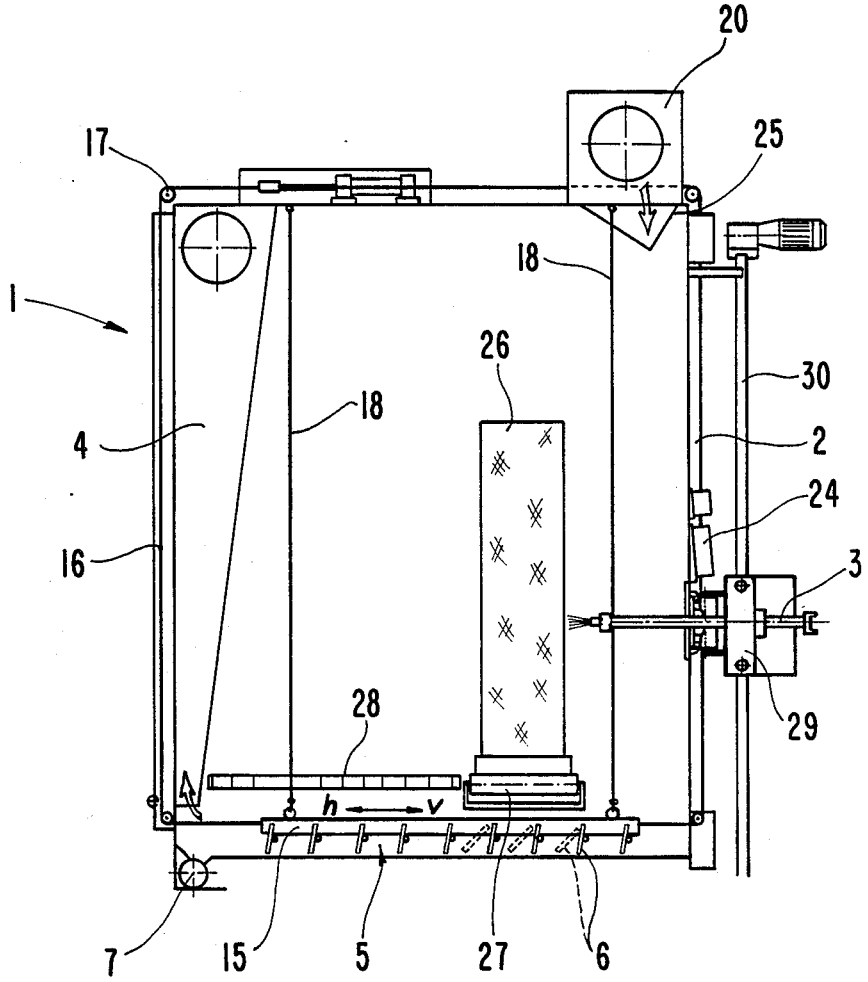
FIG. 2 is a cross-sectional view of the sandblasting cabinet of FIG. 2.

FIG. 2 shows a cross-section of the sandblasting cabinet 1 in which a workpiece 26 has been brought in by means of the roller track 27. The air intake is fitted with chicanes 25 which prevent the spreading of blasting material. The dust extraction will be made with the upwardly angled sieve 4. The air flow is in the direction as shown by the arrows, which means that the air is exhausted through the upwardly angled sieve 4 from the chicane 25 downwards. With this extraction also the dust is sucked downwards so that the view of the worker is unobstructed. A special characteristic of the invention is that the angled sieve 4 is located above the recovery channel 7. The angled sieve 4 reduces the speed of exhaust while re-usable blasting material falls down into the recovery channel 7.

An additional characteristic of the invention is in the construction of the blasting material recovery system which includes a swinging frame floor 5. The recovery frame 15 fitted with perpendicular scrapers 6 which are mounted in spaced, parallel relation to each other is suspended on ropes and only guided sidewise so that it will work wearlessly. The movement of the swinging recovery frame 5 back and forth in the direction of h and v is made by a permanent working cylinder and a rope 16. Also, by means of a rope the movement of all perpendicular scrapers 6 is set into a sloped position while this reciprocation and movement in the "v" direction places them in a rest position.

Only after the movement of the swinging frame floor 5 in the "h" direction will the perpendicular scrapers 6 be set in a working position so that the blasting material will be transported with a small stroke always about 30 cm towards the recovery channel. This transportation will be made with relay (in echelons), which means that each perpendicular scraper moves the blasting material for about 30 cm towards the recovery channel 7 and pushes it over to the next scraper.

In the pneumatic recovery channel 7 the blasting material will be vacuumed off and transported into a gathering hopper 22 above the sandblasting apparatus 21 (FIG. 3) while the transportation will be effected with a normal dust extraction device and no special unit is necessary. The turn points of the rope 17 are situated outside of the cabinet so that there is no wear. The floor is additionally covered with a grating 28.

Figure 3:
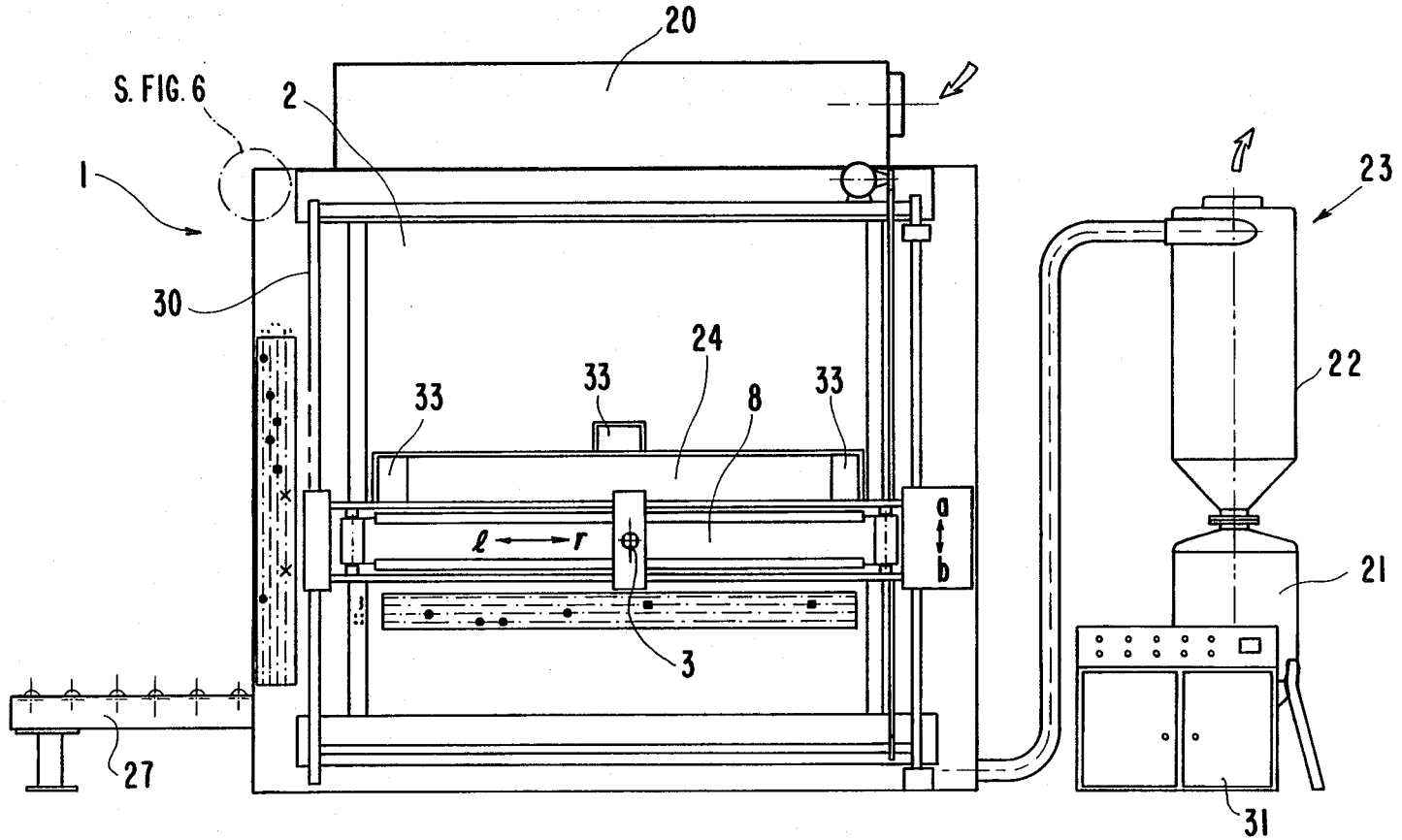
FIG. 3 is a front view of the sandblasting cabinet of FIG. 1.

FIG. 3 is a front view of the sandblasting cabinet 1 in which a roller curtain 2 is seen. Automatic sealing means 8 is incorporated into the roller curtain 2 so that the sandblasting lance 3 goes into the cabinet 1 without any leakage.

Figure 5:
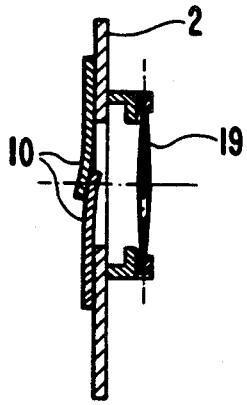
FIG. 5 is a view similar to FIG. 4, showing a seal for a manual work mode of the cabinet of FIG. 1.

If sandblasting is to be worked manually, there exists the possibility to divide the automatic sealing means 8 in the middle where the blasting lance 3 is located, and each half of the sealing means is rolled up respectively to the left and to the right so that a brush seal 19 which is mentioned in FIG. 5 can be installed. In the roller curtain 2 there is a viewing window 24 incorporated where halogen lights 33 are fixed in a special angle to the illumination of the piece which is to be sandblasted. Special features of the invention are the separate separator 23 with storage hopper 22, sandblasting apparatus 21 and control station 31.

Figure 4:
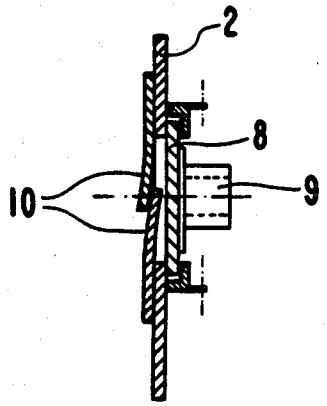
FIG. 4 is an enlarged, cross-sectional view of an automatic seal according to the present

FIG. 4 is a cross-sectional view of the roller curtain 2 where the disposition of the automatic sealing means 8 and double rubber seals 10 are shown in detail. The inlet of the blasting lance includes a guide 9 which permits passage of the lance 3 into the cabinet without leaks or fissures and is thus sound-proof.

FIG. 5 shows a cross-sectional view of another embodiment where the automatic sealing is rolled up and a brush seal 19 is fixed thereon. Also, in this embodiment, there is a sufficient sealing of the blasting room.

Figure 6A:
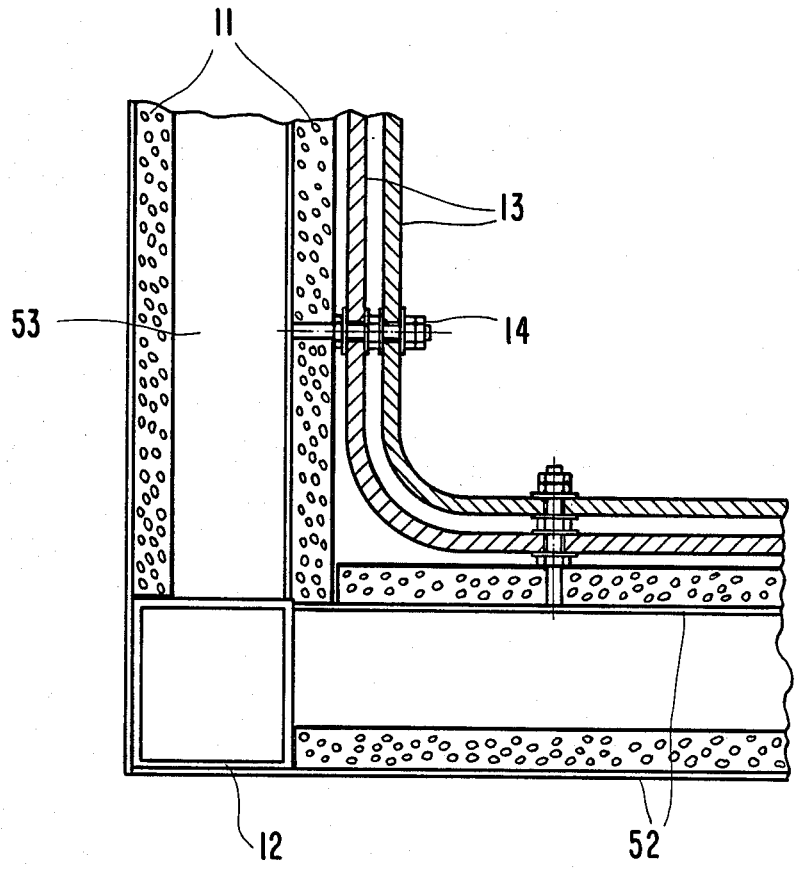
FIG. 6*a* is a cross-sectional view of a double manufactured profile frame construction according to the present invention.
Figure 6B:
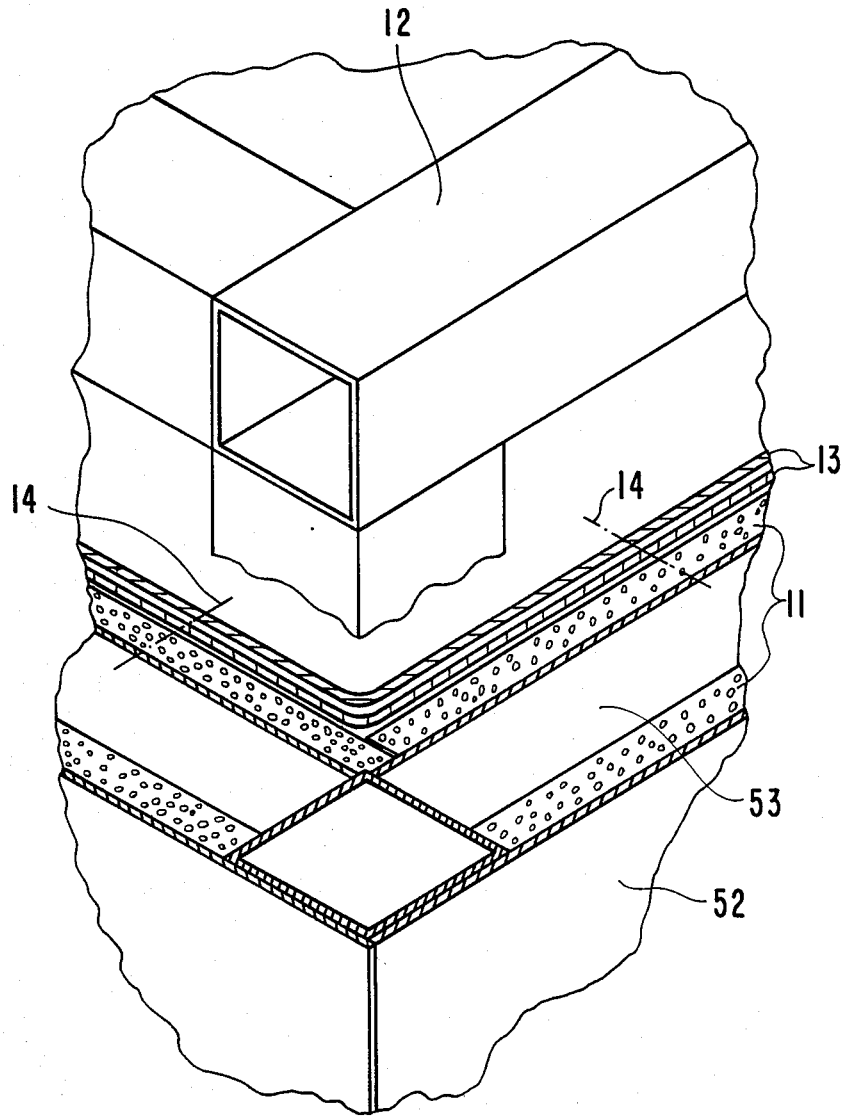
FIG. 6*b* is a perspective view of the double manufactured profile frame construction of FIG. 6*a;*

FIG. 6 is a cross-sectional view of the double manufactured profile frame construction 12. Extremely good sound-absorbing conditions are a result from the combination between sound-absorbing material 11 and the profile frame construction 12 which is twice lined with twice covered sheet steel 52, while between the sound-absorbing material 11, an air space 53 is created. Also, an air space is provided between the double layer 13 of anti-wear resistant rubber material, the two layers 13 being mounted on spacers 14.

FIG. 6*a* shows a perspective view of the profile frame construction.

Figure 8:
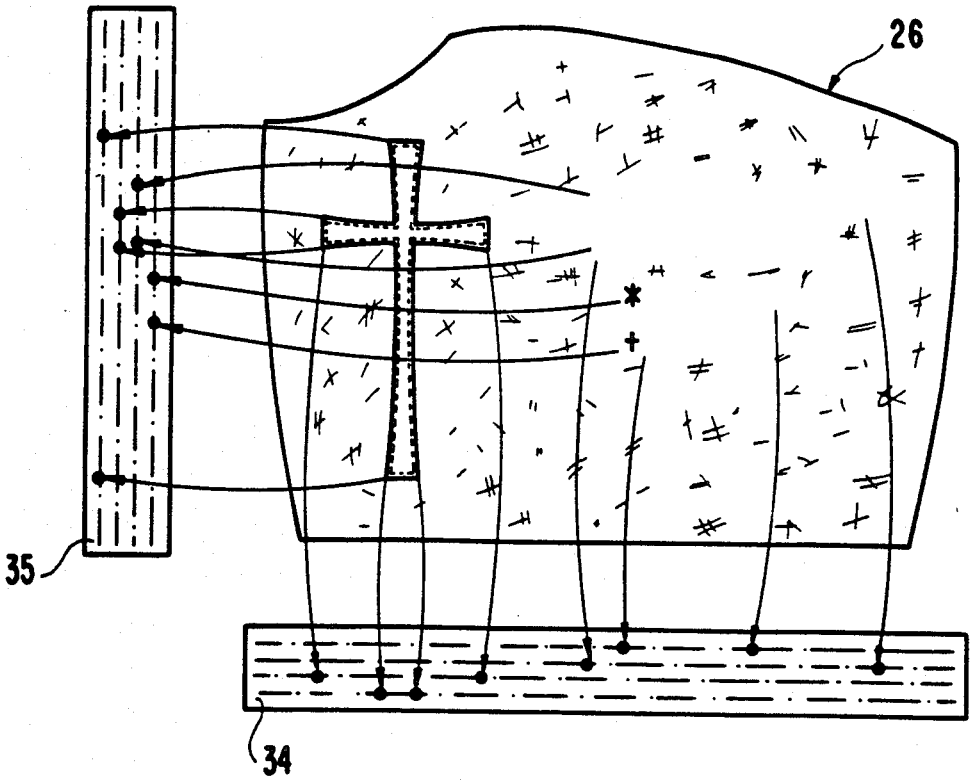
FIG. 8 is a schematic view of the guiding fields of a finished job.

Operation of the apparatus in an automatic mode will be explained with reference to FIG. 7 and 8.

Figure 7:
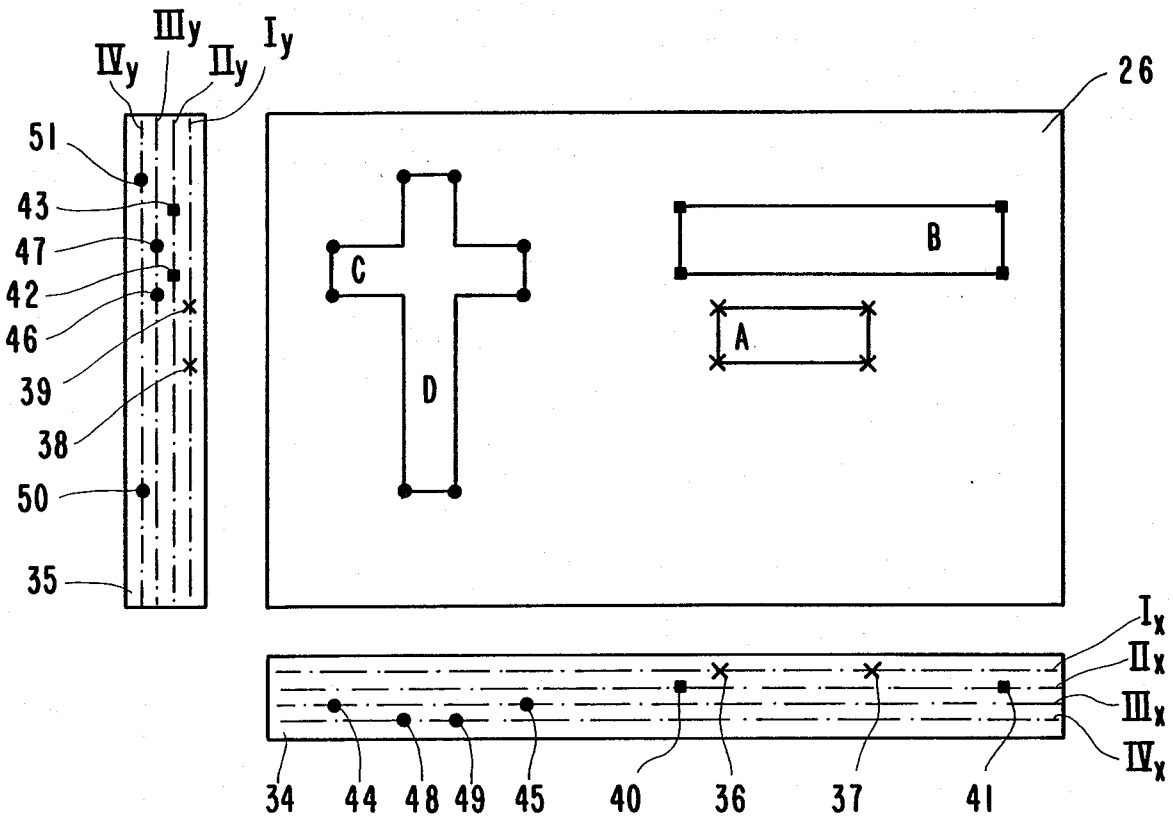
FIG. 7 is a schematic view of the guiding fields of an automatic device of the sandblast unit on which operating limits mark the limits of several working fields on a workpiece to with a nozzle.

Referring to FIG. 7, guiding fields 34 and 35 allow the determination of several rectangular working fields on the workpiece 26 which will be worked off with the blasting nozzle 3 one after the other. The number of working fields corresponds to the number of tracks Ix, IIx, IIIx, IVx, resp. Iy, IIy, IIIy, IVy, contained in the guiding fields 34 and 35. These fields can overlap themselves, for example, the tracks IIIx and IIIy are "aid" tracks to the tracks IVx and IVy. By means of these "aid" tracks it is possible to obtain a blasting field which consists of several overlapping geometrical rectangles.

For a first working field A, the operating limits 36, 37, 38, 39 are positioned on tracks Ix, Iy which are next to an inner side of the guiding fields 34 and 35, and next to the workpiece 26. The position of these operating limits 36, 37, 38, 39 determines the limits of the rectangular field A on the workpiece 26.

On the next outer track IIx of the guiding field 34 one sees the operating limits 40 and 41, and on the next outer track IIy of the guiding field 35 are the operating edges 42 and 43. These four operating limits 40, 41, 42, 43 determine the limits of another rectangular working field B on the workpiece. On the next outer tracks IIIx, IIIy, the operating limits 44, 45, 46, 47 mark the limits of a rectangular field C, and on the outer tracks IVx and IVy the operating limits 48, 49, 50, 51 determine another rectangular field D. The latest named fields C and D are in a cross shape having two widths. The width of an upright portion of the cross is determined by the operating limits 48 and 49, and the length through the operating limits 50, 51. The width of arm portions dispose on opposite sides of the upright portion is determined by the operating limits 44 and 45, and the length by the operating limits 46 and 47. The position and the size of all fields and therefore also the situation, size and form of the cross is in large part variable. The attachment of the operating limits to their fields A, B and C/D according to a congruent track followed of the two guiding fields 34 and 35 gives a clear range for the worker and a quick set up of the sandblasting device according to the invention.

With the working fields A and B one can make inscriptions, while the overlapping fields C/D collectively provided for the sandblasting of ornaments like crosses. Inscriptions and ornaments are always within the borders of the respective working fields, which are marked with the operating limits. Within these fields one works with common sandblasting techniques, especially by protecting parts of the fields A, B and C/D and leaving without protection the parts which should be treated by using script or ornament patterns. The result of such a work is illustrated in FIG. 8 which shows the attached positions of the operating limits. After having prepared the workpiece, one inputs the number of repetitions of each field, A, B and C/D, on a special input unit of the sandblasting control station 31. The number of repetitions can be different from field to field if one wants to have different depths of sandblasting. After that, the automatic device can be started whereas field by field is worked off automatically. At the overlapping fields C/D, the guiding follows such that the cross will be made line by line and step by step by the blasting nozzle; therefore, in the area of overlap between the fields C and D, there is no double treatment.

The number of repetitions will be preferably counted. When the pre-adjusted number is reached there is an automatic change to the next field which is then worked off in the same way. After treatment of the last field, the nozzle goes preferably to its starting position and shuts off. This is mainly of advantage at a sandblasting device with a combined blasting and suction head which is guided with seal over the workpiece 26. The nozzle suction head must be on the workpiece for a proper sealing and that there will be no difficulties when starting.

It is preferable to also choose an adequate final position of the combined blasting suction head so that a possible second working process or other well defined conditions are obtained. This is granted in an easy way if the blasting-suction head after having worked off the last field goes back into its starting position. When using a sandblasting cabinet, there is less necessity to provide and duplicate a preadjustable and finally reproduced starting position for the blasting nozzle.

This invention is not restricted to the number of four pairs of tracks and fields shown in this example of execution. Normally, however, the requirements are filled if there are three to five tracks on both guiding fields 34 and 35 and, with that, a corresponding number of rectangular working fields can be treated.

I claim:

1. An apparatus for sandblasting a workpiece with a blasting lance, comprising:

a sandblasting cabinet having an inner sandblasting chamber;

a dust extraction system disposed in the cabinet;

a blasting material recovery system for removing blasting material from the inner sandblasting chamber;

guide means for automatically guiding the blasting lance in an X–Y axis plane over a surface of the workpiece through a plurality of working fields designated on the surface of the workpiece; and means for determining the number and area limits of each of the plurality of working fields, the area limits being sandblasting operating limits, wherein the determining means includes a guiding field for the X axis and a guide field for the Y axis, for determining length and width limits of each of the plurality of working fields.

2. An apparatus for sandblasting according to claim 1, wherein the blasting material recovery system includes a suspended floor within the sandblasting chamber and a recovery channel disposed behind the suspended floor; and drive means for imparting reciprocating motion to the suspended floor.

3. An apparatus for sandblasting according to claim 2, wherein the drive means includes a rope connected to the suspended floor and a fluid cylinder connected to the rope.

4. An apparatus for sandblasting according to claim 2, wherein the suspended floor includes a plurality of scrapers mounted parallel to the recovery channel for pivotal movement to an upright, scraping position when the suspended floor moves towards the recovery channel, and to an angled position when the suspended floor moves away from the recovery channel.

5. An apparatus for sandblasting according to claim 1, wherein the sandblasting cabinet includes a noise reflecting vertically movable roller curtain having inner and outer sides and through which the blasting lance extends into the sandblasting cabinet.

6. An apparatus for sandblasting according to claim 5, further comprising seal means, extending horizontally on the roller curtain, for preventing sound and dust from escaping from the sandblasting chamber where the blasting lance passes through the roller curtain.

7. An apparatus for sandblasting according to claim 6, further comprising a viewing window provided in the roller curtain, and a blasting lance guide receivable in the seal means.

8. An apparatus for sandblasting according to claim 7, wherein the seal means is rollable to opposite sides from a middle thereof.

9. An apparatus for sandblasting according to claim 6, wherein the seal means includes a double overlapping rubber seal mounted on the inner side of the roller curtain.

10. An apparatus for sandblasting according to claim 9, wherein the seal means includes a brush seal detachably mounted on the outer side of the roller curtain.

11. An apparatus for sandblasting according to claim 1, wherein the cabinet includes sound proofing means.

12. An apparatus for sandblasting according to claim 11, wherein the sound proofing means includes two layers of insulating material separated by an air space and being disposed within the cabinet.

13. An apparatus for sandblasting according to claim 1, wherein the sandblasting cabinet has walls made of two layers of sheet steel provided on a frame.

14. An apparatus for sandblasting according to claim 1, further comprising a wear-resistant liner disposed within the sandblasting cabinet.

15. An apparatus for sandblasting according to claim 14, wherein the wear-resistant liner comprises two layers of wear-resistant material separated by an air space and mounted on spacers.

16. An apparatus for sandblasting according to claim 1, further comprising a roller track for moving the workpiece into the sandblasting chamber.

17. An apparatus for sandblasting according to claim 1, wherein each guiding field has a plurality of parallel tracks on which at least a pair of operating limits are disposed.

18. An apparatus for sandblasting according to claim 17, wherein the number of racks corresponds to the number of working fields.

19. An apparatus for sandblasting according to claim 18, wherein each working field is rectangular.

20. An apparatus for sandblasting according to claim 18, wherein the determining means includes input means for inputting a number of repetitions for blasting lace movement in a given working field.

21. An apparatus for sandblasting according to claim 18, wherein the determining means includes a plurality of counters corresponding to the number of working fields for counting a number of repetitions made in each corresponding working field.

22. An apparatus for sandblasting according to claim 18, further comprising means for automatically advancing the blasting lance to a next successive working field after completion of sandblasting in a preceding field.

23. An apparatus for sandblasting a workpiece with a blasting lance, comprising:

a sandblasting cabinet having an inner sandblasting chamber;

a dust extraction system including an air intake disposed in an upper forward position relative to the cabinet, an upwardly angled sieve disposed in a rearward position inside the cabinet; and a blasting material recovery system including a suspended floor within the sandblasting chamber and a recovery channel disposed beneath the upwardly angled sieve and behind the suspended floor, wherein the suspended floor includes a plurality of scrapers mounted parallel to the recovery channel for pivotal movement to an upright, scraping position when the suspended floor moves towards the recovery channel, and to an angled position when the suspended floor moves away from the recovery channel.

* * * * *